United States Patent [19]

Yamamoto et al.

[11] Patent Number: 5,005,541

[45] Date of Patent: Apr. 9, 1991

[54] HYDRAULIC VALVE LIFTER

[75] Inventors: Takeomi Yamamoto, Nishio; Nariaki Endo, Osaka; Yasushi Kadota, Osaka; Tadasu Yamakawa, Osaka, all of Japan

[73] Assignee: Otai Tekko Kabushiki Kaisha and Koyo Seiko Co., Ltd., Nishio and Osaka, Japan

[21] Appl. No.: 556,525

[22] Filed: Jul. 24, 1990

[30] Foreign Application Priority Data

Aug. 2, 1989 [JP] Japan ..... 1-91088

[51] Int. Cl.[5] ..... F01M 9/10; F01L 1/24

[52] U.S. Cl. ..... 123/90.35; 123/90.55; 123/90.56

[58] Field of Search ..... 123/90.55, 90.56, 90.33, 123/90.35

[56] References Cited

U.S. PATENT DOCUMENTS

| | | | |
|---|---|---|---|
| 3,704,696 | 12/1972 | Abell, Jr. | 123/90.35 |
| 4,279,226 | 7/1981 | Lampredi et al. | 123/90.33 |
| 4,373,477 | 2/1983 | Buente et al. | 123/90.55 |
| 4,424,774 | 1/1984 | Ferrero | 123/90.56 |
| 4,463,713 | 8/1984 | Barale | 123/90.56 |
| 4,530,320 | 7/1985 | Ferrero | 123/90.56 |
| 4,640,238 | 2/1987 | Camosso et al. | 123/90.55 |
| 4,662,324 | 5/1987 | Titolo | 123/90.55 |
| 4,745,888 | 5/1988 | Kapp | 123/90.33 |

FOREIGN PATENT DOCUMENTS

| | | |
|---|---|---|
| 57-116114 | 7/1982 | Japan . |
| 59-170603 | 11/1984 | Japan . |
| 61-145817 | 9/1986 | Japan . |
| 62-98706 | 6/1987 | Japan . |
| 62-167803 | 10/1987 | Japan . |

*Primary Examiner*—Charles J. Myhre
*Assistant Examiner*—Weilun Lo
*Attorney, Agent, or Firm*—Cushman, Darby & Cushman

[57] ABSTRACT

A hydraulic valve lifter for use in an internal combustion engine, comprises an inverted cup-like body, an inverted cup-like plunger housed within the body, a high pressure chamber defined between the body and the plunger, and an oil passage through which an oil is fed to the high pressure chamber. At least one oil discharge hole is defined in the plunger and extends from the oil passage to open to a valve stem so as to lubricate between the valve stem and a valve guide.

6 Claims, 3 Drawing Sheets

HYDRAULIC VALVE LIFTER

BACKGROUND OF THE INVENTION

1. Field of the Invention

The present invention relates to hydraulic valve lifters in a valve operating mechanism of an internal combustion engine, wherein cams work directly on valve tappets.

2. Description of the Related Art

In conventional hydraulic valve lifters which are known from U.S. Pat. No. 4,424,774 and U.S. Pat. No. 4,530,320, cams are situated closely to the upper ends of corresponding valve stems to provide a low profile valve operating mechanism. FIG. 3 illustrates a hydraulic valve lifter 31, as an example of such a conventional hydraulic valve lifter, which includes two cup like cam followers or tappets. More specifically, an inverted cup like body 34 has a cylindrical skirt 32 slidably fit within a guide hole 11 of the cylinder head I and a disk shaped tip 33 adapted to contact the cam 9. An inverted cup-like plunger 37 has a side wall 35 slidable axially within the skirt 32 of the body 34 and an end wall 36 confronting the tip 33 of the body 34. A high pressure chamber 88 is defined between the tip 33 of the body 34 and the end wall 36 confronting the tip 33. A oil is fed from the feed hole which is defined in the guide hole 11 of the cylinder head 1. The body 34 and the plunger 37 together form an oil passage 39 through which the oil is fed to the high pressure chamber 38. The plunger 37 slides downwardly and is pressed against the upper end of a valve stem 4 by hydraulic pressure of the oil 40 filled in the high pressure chamber 38.

The oil fed to the hydraulic valve lifter 31 tends to flow between a guide hole 11 of a cylinder head 1 and the skirt 32, and between the skirt 32 of the body and the side wall 35 of the plunger and is thereafter directed mostly to the outside of a valve spring 8 surrounding the valve stem 4 rather than to the valve stem 4 within the valve spring 8. As a result, the valve stem 4 and a tubular valve guide 2 which is formed in the cylinder head 1 may be burnt when an internal combustion engine runs at extremely high speeds. Such burning may cause the valve 3 to stick and break. The valve breakage may further cause the hydraulic valve lifter, the cylinder and a piston to break. Repair of those broken components requires a considerable time and is costly.

SUMMARY OF THE INVENTION

It is an object of the present invention to pro vide an improved hydraulic valve lifter which ensures sufficient lubrication between a valve stem and a valve guide so as to prevent valve burning.

In order to achieve the foregoing object, a hydraulic valve lifter according to the present invention comprises an inverted cup-like body having a skirt and a tip, an inverted cup-like plunger slidable axially within the body and having a side wall and an end wall, a high pressure chamber defined between the tip of the body and the end wall of the plunger, an oil passage through which an oil fed from the outside of the body is fed to the high pressure chamber, said oil passage being defined in the body and the plunger, and at least one oil discharge hole formed in the plunger and extending from the oil passage to open to a valve stem.

Other objects of the present invention will become apparent upon consideration of the following description of preferred embodiments and are pointed out in the appended claims. Numerous other advantages of the invention will also be appreciated as one skilled in the art carries the same into effect.

DETAILED DESCRIPTION OF THE PREFERRED EMBODIMENTS

Figure 1:
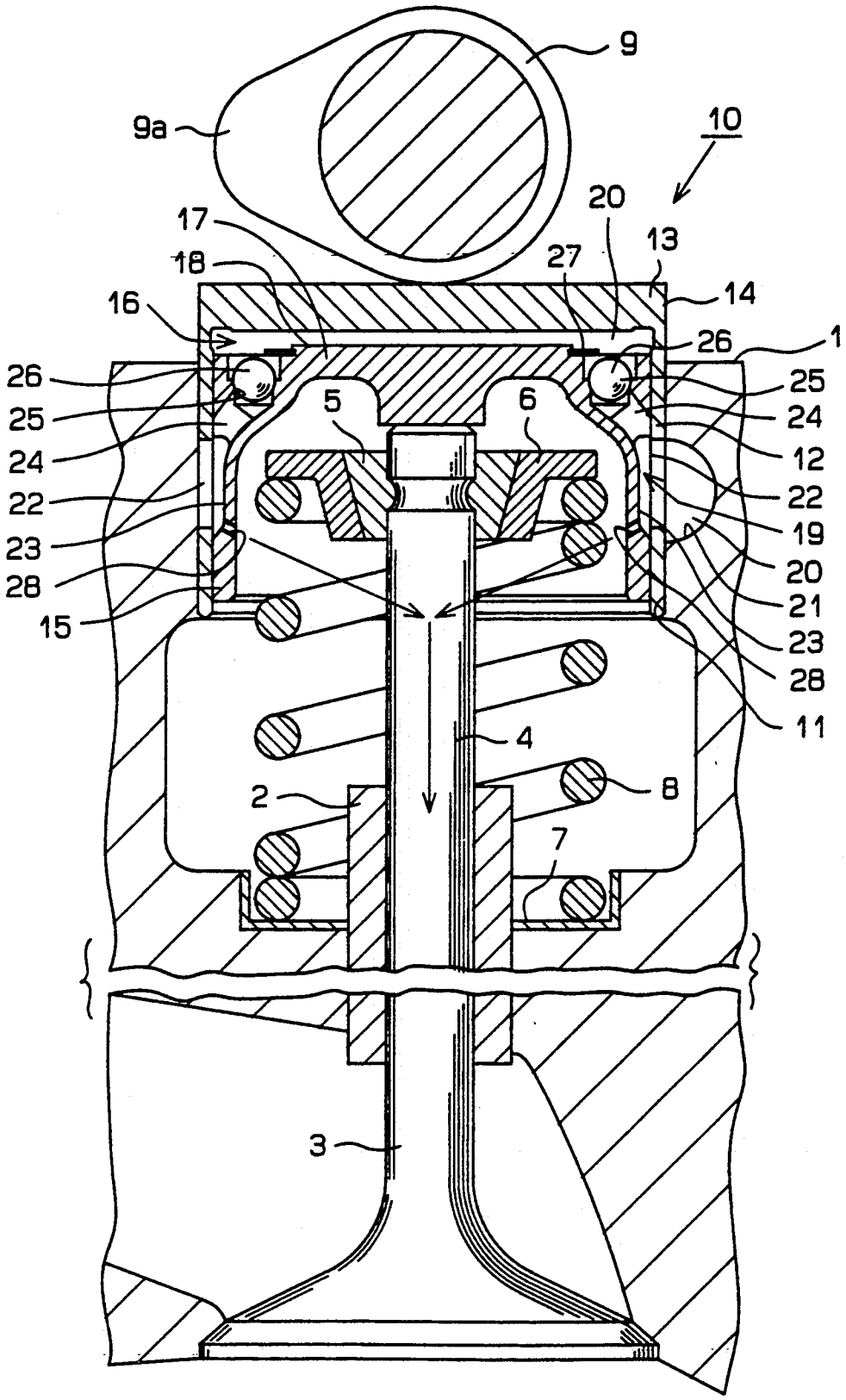
FIG. 1 is a sectional view of a first embodiment of the present invention.

A first embodiment of the present invention will now be described with reference to FIG. 1.

A cylinder head 1 of an internal combustion engine is provided with a tubular valve guide 2 through which a valve stem 4 of a valve 3 is axially slidable. A washer-shaped valve spring retainer 6 is secured to the upper end of the valve stem 4 by means of a collets 5. A valve spring 8 is disposed between the retainer 6 and a spring seat surface 7 of the cylinder head 1 to normally urge the valve 3 in an upward direction. A cam 9 is arranged to work directly on the valve 3 through a hydraulic valve lifter 10 by which a lash is automatically adjustable.

In the illustrated embodiment, the hydraulic valve lifter 10 includes an inverted cup-like body 14. The body 14 has a cylindrical skirt 12 slidably fit within a guide hole 11 of the cylinder head 1 and a disk-shaped tip 13 adapted to contact the cam 9. An inverted cup like plunger 18 is fit within the body 14 and includes a side wall 15 slidable axially within the skirt 12 of the body 14 and an end wall 17 confronting the tip 13 of the body 14 to form a high pressure chamber 16 therebetween. An oil passage 19 is defined in the body 14 so as to communicate with the high pressure chamber 16 in a manner as will be described below An oil 20 is fed to the high pressure chamber !6 through the oil passage 19 whereby the plunger 18 slides downwardly to press the upper end of the valve stem 4.

A feed hole 21 is defined in the guide hole 11 of the cylinder head 1 to communicate with an unshown oil source. The oil passage 19 includes at least one (for example four) first oil hole 22 formed in the skirt 12 of the body 14 to communicate with the feed hole 21, an annular oil groove 23 formed in the outer periphery of the side wall 15 of the plunger 18 to communicate with the first oil hole 22, and at least one (for example, two) second oil hole 24 formed in the plunger 18 and extending upwarding from the oil groove 23 to the high pressure chamber 16 A tapered seat 25 is formed in the plunger, and a check ball 26 is placed in the tapered seat 25 to open and close the second oil hole 24. A ring 27 is arranged on the end wall 17 of the plunger 18 to prevent release of the ball 26 therefrom.

At least one oil discharge hole 28 is formed in the side wall 15 of the plunger 18 below the oil groove 23. The oil discharge hole 28 extends obliquely and downwardly from the oil groove 23, part of the oil passage 19, so as to direct part of the oil fed to the oil groove 23 through the feed hole 21 to a portion of the valve stem 4 below the retainer 6. Although a single oil discharge hole can provide a desired supply of oil to the valve stem 4, a plurality of oil discharge holes are preferably formed to open to the valve stem 4 from various directions so as to supply the oil evenly thereto. It will be also appreciated that the diameter of the oil discharge hole 28 should be small, for example, 0.5 to 1.0 mm, so as to prevent excessive supply of the oil 20 therethrough and to ensure sufficient supply of the oil 20 to the oil passage 19 as a main gallery.

According to the first embodiment, the oil 20 is fed to the feed hole 21 during operation of the internal combustion engine, flows through the oil passage 19, namely, the first oil hole 22, the oil groove 23, and the second oil hole 24 in that order, and enters into the high pressure chamber 16 by moving the ball 26 upwards. The plunger 18 is then moved downwards under hydraulic pressure of the oil filled in the high pressure chamber 16 so as to contact the upper end of the valve stem 4. When the tip 13 of the body 14 is moved downwardly by a cam nose 9*a*, the ball 29 closes the second oil hole 24 so as to prevent the oil 20 to flow from the high pressure chamber to the oil passage 19. Accordingly, a lash can be automatically adjusted.

At this time, part of the oil 20 in the oil groove 23 is directed to the valve stem 4 through the oil discharge hole 28. Such oil is directly attached to the valve stem 4 or becomes misty on the valve spring 8 once and is attached to the valve stem 4. The oil then flows downwardly along the valve stem 4 and enters between the valve stem 4 and the valve guide 2 to lubricate the same. Under the circumstances the valve stem 4 and the valve guide 2 no longer suffer from burning when the internal combustion engine runs at extremely high speeds. Thus, breakage of the valve, the valve lifter, the cylinder, and the piston due to valve burning will be avoided.

Figure 2:
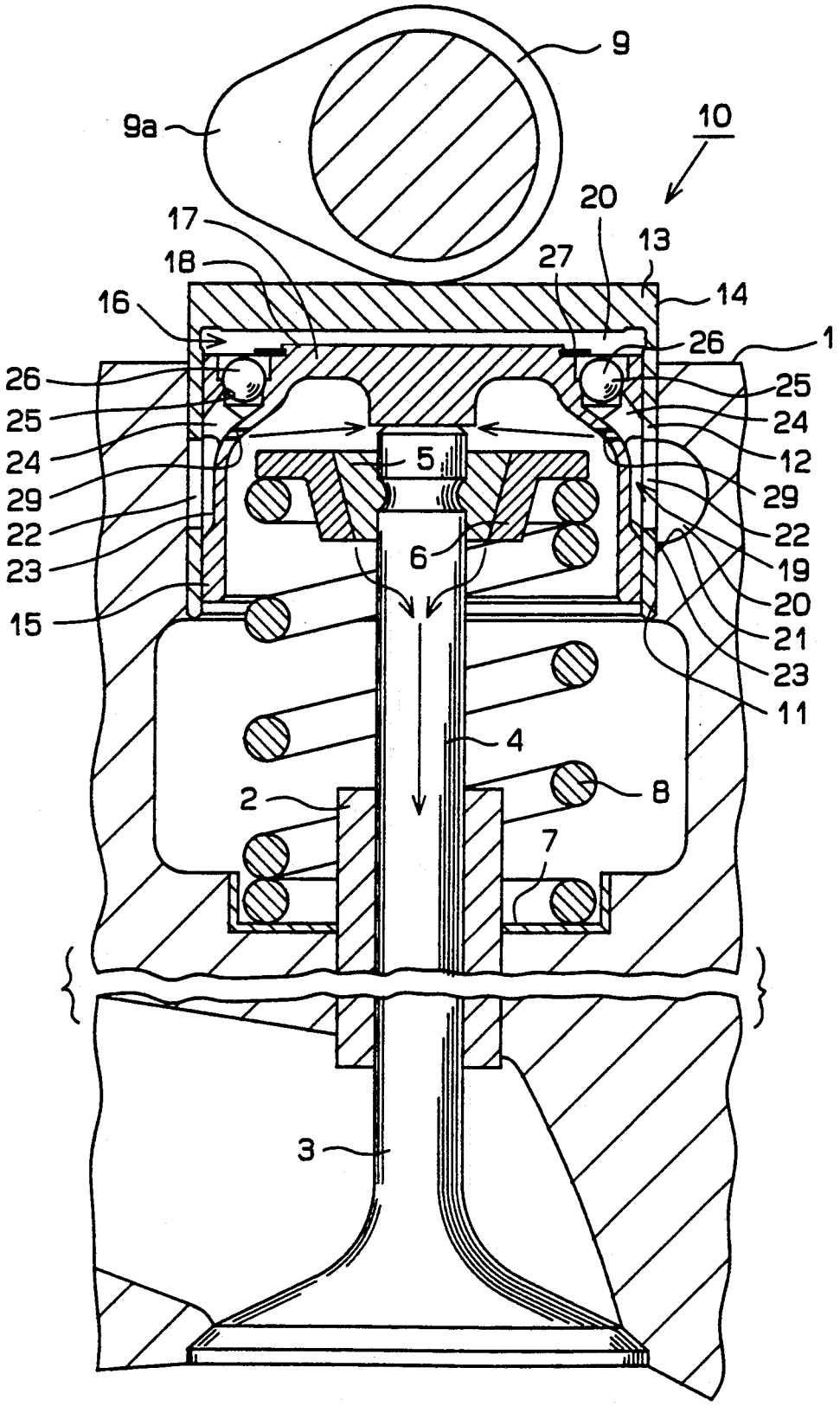
FIG. 2 is a sectional view of a second embodiment of the present invention.
Figure 3:
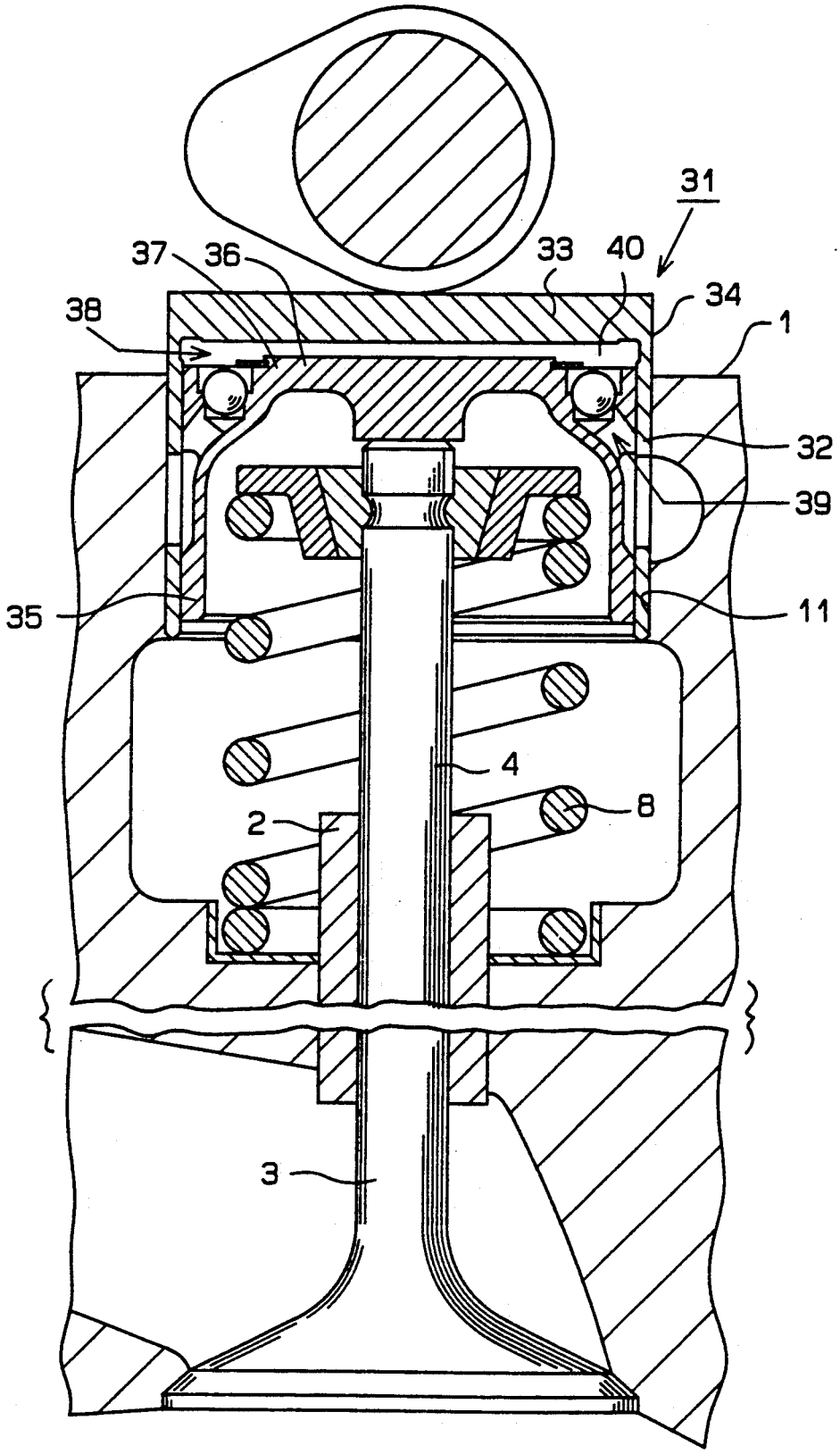
Fig.3 (PRIOR ART)
FIG. 3 is a sectional view of a conventional hydraulic valve lifter.

A second embodiment of FIG. 2 differs from the first embodiment only in terms of the position of an oil discharge hole. Specifically, at least one oil discharge hole 29 is formed in the side wall 15 of the plunger 18 above the oil groove 23 or about the second oil hole 24 (but below the seat 25). This oil discharge hole 29 extends substantially horizontally from the oil groove 23 or the second oil hole 24, as part of the oil passage 19, to open to a portion of the valve stem 4 above the retainer 6. It will be noted that the oil discharge hole 29 is identical in number and diameter to the oil discharge hole 28 of the first embodiment.

With this arrangement, the oil 20 in the oil groove 23 or the second oil hole 24 is partly discharged to the upper end of the valve stem 4 through the oil discharge hole 29 and attached thereto as well as to the collet 5 and the upper surface of the retainer 6. The oil 20 then enters between the collet 8 and the retainer 6. The oil 20 further flows downwardly along the valve stem 4 and enters between the valve stem 4 and the valve guide 2. Thus, the second embodiment provides the same advantages as the first embodiment does.

It is clear that various modifications may be made without departing from the spirit and scope of the invention. The invention is not limited to the particular embodiments, but only by the appended claims.

What is claimed is:

1. A hydraulic valve lifter comprising:

an inverted cup-like body having a skirt and a tip;

an inverted cup-like plunger slidable axially within said body and having a side wall and an end wall;

a high pressure chamber defined between the tip of said body and the end wall of said plunger;

an oil passage through which an oil fed from the outside of the body is fed to the high pressure chamber, said oil passage being defined in said body and said plunger; and at least one oil discharge hole formed in said plunger and extending from said oil passage to open to a valve stem.

2. A hydraulic valve lifter according to claim 1, wherein said oil passage includes a first oil hole defined in the skirt of said body, an annular oil groove formed in the outer periphery of the side wall of said plunger and communicated with said first oil hole, and a second oil hole defined in said plunger and extending upwardly from said oil groove to said high pressure chamber.

3. A hydraulic valve lifter according to claim 1, wherein said oil discharge hole extends through said side wall of said plunger.

4. A hydraulic valve lifter according to claim 3, wherein said oil discharge hole opens to a portion of said valve stem below a valve spring retainer.

5. A hydraulic valve lifter according to claim 3, wherein said oil discharge hole opens to a portion of said valve stem above a valve spring retainer.

6. A hydraulic valve lifter according to claim 1, wherein said oil discharge hole opens to said valve stem from various directions.

* * * * *